US012421969B2

(12) United States Patent
Lovell

(10) Patent No.: US 12,421,969 B2
(45) Date of Patent: Sep. 23, 2025

(54) AIR COMPRESSOR SYSTEMS FOR REMOTE SETTINGS

(71) Applicant: Fisher Controls International LLC, Marshalltown, IA (US)

(72) Inventor: Michel K. Lovell, Marshalltown, IA (US)

(73) Assignee: Fisher Controls International LLC, Marshalltown, IA (US)

( * ) Notice: Subject to any disclaimer, the term of this patent is extended or adjusted under 35 U.S.C. 154(b) by 198 days.

(21) Appl. No.: 18/464,688

(22) Filed: Sep. 11, 2023

(65) Prior Publication Data

US 2025/0084855 A1 Mar. 13, 2025

(51) Int. Cl.

| | |
|---|---|
| ***F04D 25/04*** | (2006.01) |
| ***F04D 25/02*** | (2006.01) |
| ***F04D 25/08*** | (2006.01) |
| ***F04D 27/00*** | (2006.01) |

(52) U.S. Cl.

CPC ..... *F04D 25/04* (2013.01); *F04D 25/024* (2013.01); *F04D 25/08* (2013.01); *F04D 27/004* (2013.01)

(58) Field of Classification Search

CPC ..... F04D 25/04; F04D 25/024; F04D 25/08; F04D 27/004

See application file for complete search history.

(56) References Cited

U.S. PATENT DOCUMENTS

| | | | | | |
|---|---|---|---|---|---|
| 4,420,950 | A * | 12/1983 | Bodas | F02C 7/143 | 62/305 |
| 5,372,010 | A * | 12/1994 | Gratz | F17D 1/04 | 165/45 |
| 6,056,004 | A * | 5/2000 | Agnew | F16L 55/00 | 60/785 |
| 2010/0003147 | A1* | 1/2010 | Takahashi | F04C 23/008 | 418/83 |
| 2019/0041124 | A1* | 2/2019 | Berti | F25B 11/04 | |

OTHER PUBLICATIONS

Emerson Process Management Regulator Technologies, Inc., https://www.emerson.com/documents/automation/data-sheets-168-168h-68-2-three-way-snap-acting-switching-valve-bulletin-fisher-en-en-6075310.pdf, Bulletin 71.7:168, 1993, 2009, printed Feb. 8, 2024, 4 pages.

Air Squared Scroll Technology, Scroll Expander Produces 1kW of Quiet Power, https://airsquared.com/news/scroll-expander-produces-1-kw-of-quiet-power/, printed Feb. 8, 2024, 4 pages.

* cited by examiner

*Primary Examiner* — Bryan M Lettman
(74) *Attorney, Agent, or Firm* — Quarles & Brady LLP

(57) ABSTRACT

An air compressor system is provided for generating compressed air for one or more pneumatic instruments on a pipeline section. The pipeline section may include a valve defining an upstream portion and a downstream portion. In one example, an expander is configured to selectively receive process fluid from the upstream portion of the pipeline via an input line. In another example, a compressor is configured to receive air via an air input line and to output compressed air to an air tank via an air output line. The expander may power the compressor via the expansion of process fluid through the expander. In one example, the expander outputs the process fluid into the downstream portion of the pipeline via an output line.

20 Claims, 2 Drawing Sheets

AIR COMPRESSOR SYSTEMS FOR REMOTE SETTINGS

CROSS-REFERENCE TO RELATED APPLICATION

Not applicable.

BACKGROUND

Fluid control systems can be used in a variety of industrial, commercial, and other settings to regulate, protect, isolate, or maintain pipes, conduits, or other vessels and the flow of fluid therein (e.g., within a pipeline). In some applications, these fluid control systems may utilize compressed air (e.g., instrument air) to control or manage fluid flow. However, typical compressors may utilize electrical power sources, which may be unavailable in certain remote locations. Thus, it may be useful to generate compressed air, which can be used to manage or control fluid flow in pipelines, in locations where certain power sources are unavailable.

SUMMARY

Some embodiments of the invention provide an air compressor system for generating compressed air for one or more pneumatic instruments on a pipeline section. The pipeline section may include a valve defining an upstream portion and a downstream portion. In one example, an expander is configured to selectively receive process fluid from the upstream portion of the pipeline via an input line. In another example, a compressor is configured to receive air via an air input line and to output compressed air to an air tank via an air output line. The expander may power the compressor via the expansion of process fluid through the expander. In one example, the expander outputs the process fluid into the downstream portion of the pipeline via an output line.

Some embodiments of the invention provide a method of compressing air. In one example, the method includes selectively routing process fluid from an upstream portion of a pipeline to an expander via an input line. In one example, the pipeline includes a valve between the upstream and a downstream portion of the pipeline. The method further includes, expanding the process fluid with the expander so that the expander rotates to power a compressor. The compressor thereby operates to receive air via an air input line and to output compressed air to an air tank via an air output line. The method further includes, routing the expanded process fluid from the expander into the downstream portion of the pipeline via an output line.

Some embodiments of the invention provide an air compressor system for generating compressed air for one or more pneumatic instruments. The system may include a process fluid portion and an instrument air portion. The process fluid portion may include a pipeline section including a valve defining an upstream portion and a downstream portion of the pipeline and an expander in fluid communication with the pipeline. In one example, the expander is configured to selectively receive process fluid from the upstream portion of the pipeline via an input line and to provide expanded process fluid to the downstream portion of the pipeline via an output line. The instrument air portion may include a compressor in mechanical communication with the expander to be powered by rotation of the expander. The compressor may be configured to receive air for compression at an air inlet and supply compressed air to an air tank in fluid communication with the compressor. In one example, the air tank is configured to supply compressed air from the compressor to one or more pneumatic instruments. In one example, the compressor is powered via the flow of process fluid from the upstream portion of the pipeline to the downstream portion of the pipeline through the expander.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
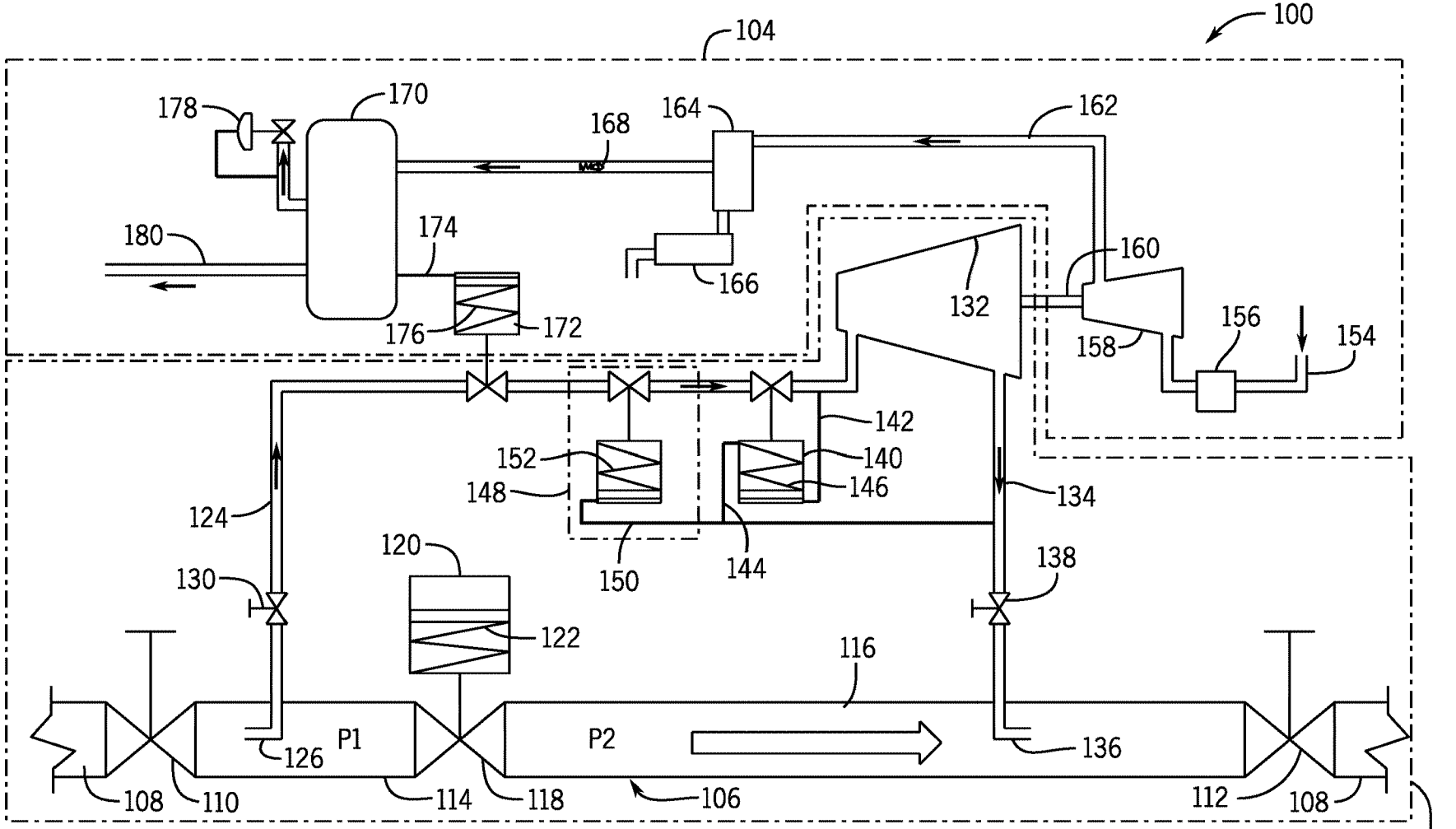
FIG. 1 is a schematic view of an example of pipeline with an air compressor system for according to aspects of the present disclosure.

The following discussion is presented to enable a person skilled in the art to make and use embodiments of the invention. Given the benefit of this disclosure, various modifications to the illustrated embodiments will be readily apparent to those skilled in the art, and the principles herein can be applied to other embodiments and applications without departing from embodiments of the invention. Thus, embodiments of the invention are not intended to be limited to embodiments shown, but are to be accorded the widest scope consistent with the principles and features disclosed herein.

The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As briefly discussed above, fluid control systems can be used in a variety of industrial, commercial, and other settings to control fluid flow through pipes, conduits, or other vessels. For example, some process systems, including off-shore drilling wells, oil fields, natural gas transmission pipelines, etc. may (occasionally) require valve actuation at remote or difficult to access sites. Such remote sites may lack a reliable power source, or may otherwise be sometimes subject to power loss events, and thus would benefit from systems for valve actuation without outside power sources, and without unnecessary loss of fluid (e.g., natural gas).

Accordingly, embodiments of the invention can provide an air compressor system configured to generate compressed air without the need for an outside power source. In one example, an air compressor can be powered by a process fluid flowing through a pipeline to provide compressed air for operation of one or more instruments along the pipeline. In one example, the flow of process fluid may operate an expander that is configured to power the compressor (e.g., via a rigid shaft or other mechanical connection between the expander and the compressor). Further, the expander can be configured to vent the expanded process fluid into a downstream portion of the pipeline, without loss of the fluid to the atmosphere. Thus, an expander-driven air compressor system may provide compressed air (e.g., instrument gas) used to control one or more instruments without the need for an outside power source and without emission of process fluid during operation or during idle states.

In one particular example, a series of valve arrangements can be used to control flow of process fluid along an input line to an expander. For example, flow to the expander—and thereby, indirectly, a speed of a connected compressor—can be controlled by a series of regulators or other valve arrangements with reference to a pressure differential across the expander, a pressure of an air tank supplied by the compressor, or a downstream pressure of a pipeline, in various combinations.

FIG. 1 illustrates an example of an air compressor system 100. In one example, the air compressor system 100 may be an expander-driven air compressor system including a process fluid portion 102 and an instrument air portion 104. In one example, the air compressor system 100 may be used on a pipeline 106. The pipeline 106 may be a natural gas pipeline. In one example, the pipeline 106 may include a valve 118 arranged to control fluid flow rate or pressure drop between an upstream portion 114 (with respect to valve 118) and a downstream portion 116 (with respect to valve 118) of the pipeline 106. The valve 118 may be any of a variety of known types, such as a ball valve, gate valve, butterfly valve, diaphragm valve, globe valve, plug valve, check valve, or any other form of valve used to modify pipeline pressure or flow.

In some cases, an operator may desire to isolate a portion of the pipeline 106. For example, a portion of the pipeline may be isolated to enable maintenance or replacement of a section of the pipeline 106. To enable the operator to isolate a portion of the pipeline 106, the pipeline may include a set of isolation valves 110, 112. The isolation valves 110, 112 may be operated by a user in order to isolate (i.e., fluidically separate) the upstream portion 114 and the downstream portion 116 from a remainder 108 of the pipeline 106. In one example, the isolation valves 110, 112 are manual valves each including a manually operable valve stem configured to be actuated by a user or operator. In other examples, the isolation valves 110, 112 may be any other form of valve. In one example, closing or shutting of the isolation valves 110, 112 eliminates the flow of process gas through the isolated portion (e.g., upstream portion 114 and downstream portion 116). As a result, the valve 118 may be rendered inoperable due to lack of pressure drop (e.g., zero pressure drop, no differential pressure to operate actuator 120) between the upstream and downstream portions of the pipeline 106.

In the illustrated example, the valve 118 may be stroked (i.e., moved/actuated) via an actuator 120 to close, open, or otherwise adjust a position of a valve stem of the valve 118. Thus, through control of the actuator 120, the valve 118 can be controlled to generate a particular pressure drop across the valve 118 or a particular flow rate of fluid into the downstream portion 116 of the pipeline 106. In one example, the actuator 120 may be a double acting piston type actuator. In another example, the actuator may be a single acting piston type actuator, or may have other known configurations. In some examples, the actuator may include a biasing element 122 (e.g., spring) configured to cause the actuator to "fail-open" in certain situations (e.g., situations with insufficient differential pressure (dP) to operate the actuator 120). In other examples, the biasing element 122 may be configured to cause the actuator to "fail-closed" in certain situations.

In one example, the process fluid portion 102 of the system 100 includes the pipeline 106 and an expander 132 configured to generate work (e.g., via powered rotation, etc.) sufficient to power a compressor 158 located within the instrument air portion 104 of the system 100. Generally, the compressor 158 may be a scroll compressor or any other form of compressor, as suitable to a particular installation. In one example, the expander 132 may be a large volume expander and the compressor 158 may be a small volume compressor, which provides a total pressure ratio of 20:1 (e.g., 20 psi of compression for 1 psi of expansion).

In one particular example, the process fluid portion 102 and the instrument air portion 104 are separate systems (i.e., fluidically isolated systems, with no exchange of working fluids), which are connected via a shaft 160 between the expander 132 and the compressor 158. The shaft 160 may be configured to impart work (e.g., power, rotation, etc.) from the expander 132 to operate the compressor 158.

In one example, the combination of the compressor 158 and the expander 132 may be configured as a compander. In other words, the compressor 158 can be mechanically coupled to the expander 132 so that expansion of the supply gas through the expander 132 provides rotational power to compress the air through the compressor 158. In some examples, a compander can be configured as a unitary assembly, with integrated housings, support structures, or other common features.

In one example, the expander 132 may be connected to the upstream portion 114 of the pipeline 106 via an input line 124 and connected to the downstream portion 116 of the pipeline 106 via an output line 134. The input line 124 may route process fluid (e.g., natural gas) from the upstream portion 114 of the pipeline 106 via an inlet port 126. Correspondingly, the output line 134 may reinject process fluid (e.g., expanded process fluid at a reduced pressure) from the expander 132 into the downstream portion 116 of the pipeline 106 via an outlet port 136.

In some cases, an outlet port for providing expanded process fluid back into a pipeline can be a pressure-reducing port, i.e., a port configured to effectively reduce the local pressure into which the expanded flow is received. Similarly, an inlet port for provided process fluid from a pipeline to an expander can be a pressure-increasing port, i.e., a port configured to effectively increase the local pressure of the received process fluid. In this regard, in one example, the inlet port 126 and the outlet port 136 may be in the form of pitot tube style ports to generate increased differential pressure between the upstream and downstream portions of the pipeline, relative to the process flow through the expander 132. For example, as shown in FIG. 1, the inlet port 126 is a pitot tube facing in the upstream direction, so that the input line 124 is exposed to the velocity pressure of the flow along the pipeline 106. In contrast, the outlet port 136 is a pitot tube facing in the downstream direction, so that the output line 134 is not exposed to the velocity pressure of the flow along the pipeline 106. In other examples, other generally known devices can be similarly employed (e.g., a venturi device at the output line 134). In other examples, the inlet and outlet ports may be a straight pressure taps (e.g., branched or direct connection) or any other form of ports.

In one example, both the input line 124 and the output line 134 may each include an isolation valve configured to prevent process fluid flow to the expander 132. For example, the input line 124 may include an isolation valve 130 and the output line 134 may include an isolation valve 138. The isolation valves 130, 138 may be actuated by a user to block prevent process fluid flow to or from the expander 132. As should be appreciated, blocking off or preventing process fluid flow to reach the expander 132 correspondingly prevents the compressor 158 from compressing (e.g., pressurizing) air. Thus, actuating the isolation valves 130, 138 effectively shuts off the compressor 158. In one example, the isolation valves 130, 138 are manual valves, each including a manually operable valve stem configured to be actuated by a user. In other examples, the isolation valves 130, 138 may be any other form of valve.

In one example, the process fluid portion 102 of the air compressor system 100 may include one or more regulators or other valve arrangements configured to control the flow of process fluid into the expander 132 (e.g., arranged in series along the input line 124). Because the compressor 158 and the expander 132 are connected (e.g., via the shaft 160), regulating the process fluid flow into the expander 132 correspondingly regulates a compression value of the compressor 158. Put differently, regulating amount of work done by the expander (e.g., by regulating the amount of input process fluid) likewise regulates an output air pressure from the compressor 158 via supplying more or less power (e.g., rotation speed of shaft) to the compressor 158. Thus, output air pressure from the compressor 158 can be regulated via control of a flow of process fluid through the input line 124. In some cases, regulating the process fluid flow into the expander 132 can be based on a pressure of an expanded process fluid that is output from the expander 132 to the downstream portion 116 of the pipeline 106. Thus, the regulators or other valve arrangements may further protect the expander 132 from operating at an excessive speed, which may damage the expander 132, compressor 158, and can protect the downstream portion 116 of the pipeline 106 against exceeding a maximum allowable operating pressure (MAOP) of the downstream portion 116.

In one example, a speed control regulator 140 is arranged on the input line 124 to prevent the expander 132 from operating at an excessive speed. The speed control regulator 140 may include a biasing element 146 (e.g., a spring or other biasing element) configured to bias the regulator open, to enable process fluid flow into the expander 132 under certain conditions. To regulate the flow of process fluid into the expander 132 the speed control regulator 140 includes an input reference line 142 and an output reference line 144. In the illustrated example, the reference lines 142, 144 are configured to monitor a pressure in the input line 124 and the output line 134, respectively. In another example, these or other reference lines may otherwise monitor a differential pressure across the expander 132.

In one example, when the pressure difference between the output line 134 and the input line 124 exceeds a predetermined threshold, the regulator 140 begins to close (e.g., overcomes biasing force from biasing element 146), which thereby reduces the flow of process fluid into the expander 132. Thus, the expander 132 can protected from excessive speeds, which may result from a high flow rate or pressure in the input line 124 and a correspondingly high pressure drop across the expander 132. In contrast, if the pressure differential decreases, the regulator 140 may begin to open (e.g., assisted by biasing element 146) to allow a greater flow of process fluid into the expander 132. Further, at relatively low-pressure differentials, the regulator 140 can be held fully open (e.g., by the biasing element 146). Among other benefits, this arrangement of the regulator 140 can provide useful supply of process fluid for compression of air, while helping to avoid excessive compressor speed when the valve 118 causes a high pressure drop between the upstream and downstream portions 114, 116.

In another example, a MAOP regulator 148 may be positioned on the input line 124 (e.g., upstream of the speed control regulator 140) to help protect the pipeline 106, and particularly the downstream portion 116, against over-pressurization. In some examples, the MAOP regulator 148 may include a biasing element 152 (e.g., a spring or other biasing element) configured to enable process fluid flow into the expander 132 under certain conditions. For example, the biasing element 152 may be configured to bias the MAOP regulator 148 fully-open unless a pressure in the output line 134, as determined by a reference line 150, is above a predetermined threshold. Thus, if the output line 134 is above a predetermined pressure threshold (i.e., if P2 or an expanded process fluid being reinjected into downstream portion 116 of pipeline 106 is above a predetermined pressure), the regulator 148 begins to close (e.g., against biasing force of biasing element 152). In this way for example, the regulator 148 can protect against P2 exceeding a set pressure via leakage of process fluid through the expander 132 when the valve 118 is closed.

To further control the pressurization of air by the compressor 158 (e.g., to control pressure at an output of the compressor 158, which supplies an air tank 170), an air pressure regulator 172 may be positioned on the input line 124 (e.g., upstream of the MAOP regulator 148 and the speed control regulator 140). The air pressure regulator 172 is configured to monitor the air pressure in the air tank 170 via a reference line 174. If the pressure in the air tank 170 is above a predetermined threshold, the regulator 172 is configured to close (e.g., against biasing element 176), which restricts the flow of process gas into the expander 132 via the input line 124. As described previously, restricting the flow of process gas into the expander 132 correspondingly lowers the output of power from the expander 132 to the compressor 158 via the shaft 160, which lowers the pressure of the compressed air from the compressor 158. In contrast, if the pressure in the air tank 170 falls, the regulator 172 can be configured to open, to correspondingly increase flow to the expander 132. In one example, the biasing element 176 (e.g., a spring or other biasing element) may be configured to bias the air pressure regulator 172 fully-open, unless the pressure in the air tank 170 is above a predetermined threshold (e.g., high enough to overcome biasing force from biasing element 176 and close regulator 172). Thus, the pressure in the air tank 170 can be regulated via control of the flow of process fluid into the expander 132.

In an example use case, air (e.g., from the atmosphere surrounding the system 100) enters an air inlet 154 of the instrument air portion 104 due to suction pressure from the compressor 158. The can air flow through an air filter 156 configured to remove particulates or debris from the air, which may harm the compressor 158. The air then flows into the compressor 158, which compresses the air to a pressure value sufficient to operate one or more instruments (e.g., pneumatic instruments along pipeline 106). In particular, as mentioned previously, the compressor 158 may be powered via the expansion of process gas from the pipeline 106 through the expander 132. Thus, the output pressure value of compressed air from the compressor may be controlled via control of the flow of process fluid from the upstream portion 114 of the pipeline 106 into the expander 132, and the expanded process fluid can be reinjected into the downstream portion 116 of the pipeline 106 to avoid the loss of process fluid (e.g., natural gas) to the atmosphere.

Continuing the example use case above, the compressed air output from the compressor 158 can flow downstream through a compressed air line 162, and through an air dryer 164 including a drain 166. The dryer 164 is configured to manage the dewpoint (e.g., moisture content) of the compressed air and discard moisture from the air via the drain 166. In one example, the drain 166 may be a fully-pneumatic automatic water drain. The dried compressed air can then flow from the dryer 164 past a check valve 168, which prevents backflow of compressed air from the air tank 170. As described previously, compressed air can flow into the air tank 170, which is configured to hold compressed air for use by one or more instruments (e.g., pneumatic instruments along the pipeline 106 or remote to pipeline 106). In some examples, the compressed air can be used to operate one or more pipeline valves (e.g., the valve 118, via any of various known pneumatic control assemblies (not shown)). In one example, the air tank 170 may include a relief valve 178 configured to enable the venting or release of compressed air to the atmosphere in the event of over-pressurization of the air tank 170. The air tank 170 may further include compressed air outlet 180, which allows compressed air to flow from the tank 170 to one or more instruments (e.g., remotely located pneumatic instruments, for control of pipeline valves or other equipment).

As should be appreciated, the system 100 can thus function in a zero-emission state, meaning that the system 100 functions without the loss of process fluid (e.g., natural gas) to the atmosphere during operation or while in an idle state. As should be appreciated, this configuration can help to prevent loss of valuable material (e.g., loss of process fluid) and avoidance of release events that may incur reporting requirements or other regulatory consequences (e.g., relating to venting of natural gas to the atmosphere). Additionally, the system 100 is able to function independent of outside sources of power (e.g., electricity), which allows for the system 100 to operate in remote locations, without the need for electrical equipment to compress air for pneumatic controls or otherwise operate the one or more instruments.

Figure 2:
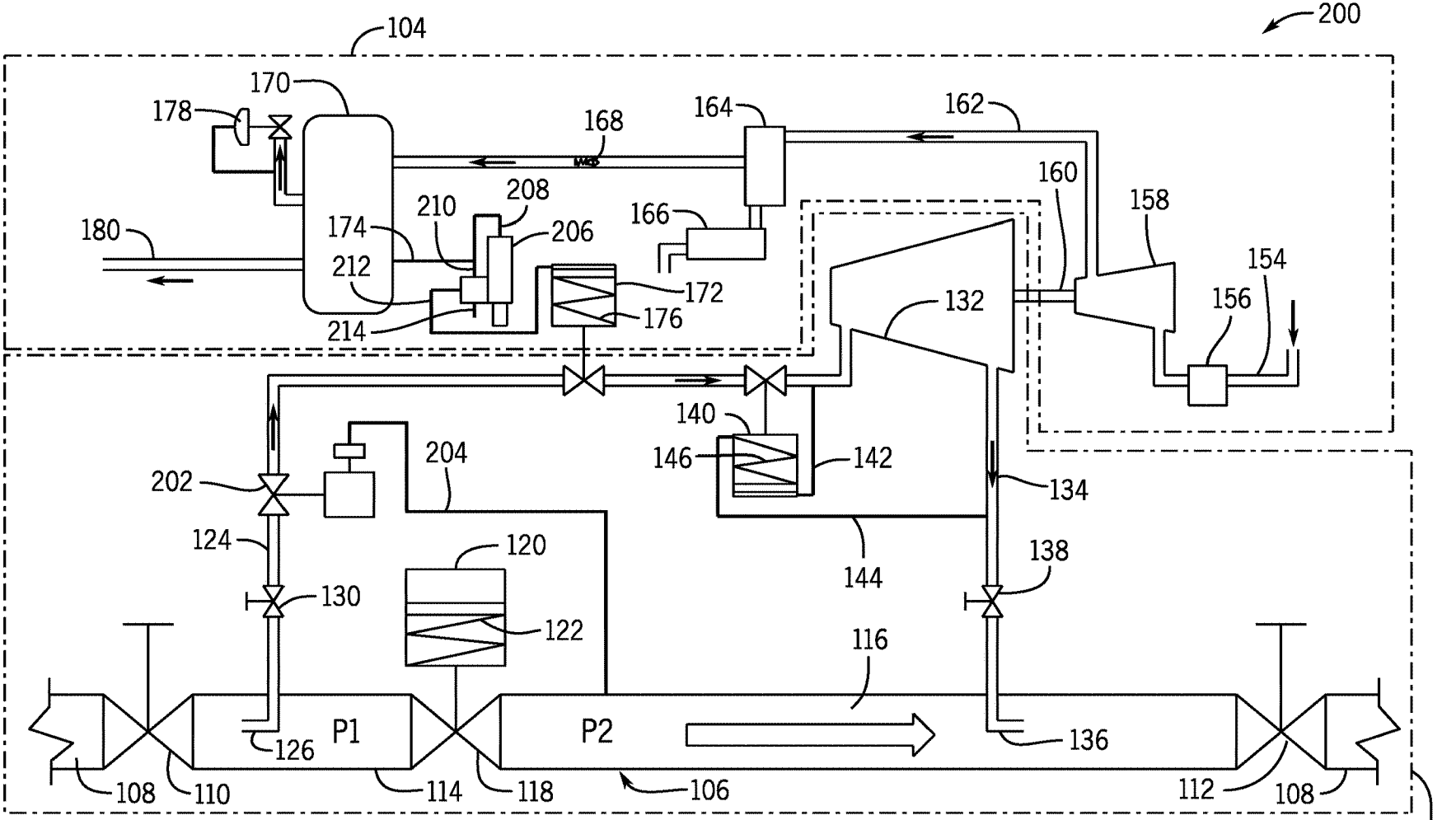
FIG. 2 is a schematic view of the pipeline of FIG. 1 including another configuration of an expander-driven air compressor system according to aspects of the disclosure.

FIG. 2 illustrates another example of an expander-driven air compressor system 200 for use with the pipeline 106 (e.g., as an alternative configuration of the air compressor system 100). As will be recognized, the system 200 shares a number of components in common with and operates in a similar fashion to the examples illustrated and described previously. For the sake of brevity, these common features will not be again described below in detail. Rather, previous discussion of commonly named or numbered features, unless otherwise indicated, also apply to example configurations of the system 200.

In place of the regulator 148 (or otherwise), the system 200 may include a slam-shut valve 202 configured to protect the pipeline 106 from over-pressurization. For example, the slam-shut valve 202 includes a reference line 204 that monitors a pressure in the downstream portion 116 of the pipeline 106. In one example, the slam-shut valve 202 is configured to shut rapidly and completely in response to a pressure in the downstream portion 116 of the pipeline 106 at or above a predetermined maximum operating pressure of the pipeline 106. Thus, for example, if the pressure in the downstream portion 116 of the pipeline 106 is below a predetermined threshold the valve 202 may be in a fully-open position and if the pressure in the downstream portion 116 of the pipeline 106 is above a predetermined threshold the valve 202 may be in a fully-closed position.

In place of the arrangement shown in FIG. 1 (or otherwise), a valve 206 can be configured to control operation of the compressor based the pressure of the compressed air from an output of the compressor 158 (e.g., the compressed air stored in the air tank 170). In some examples, the valve 206 is a three-way valve (or a three-way switching valve) that may be positioned between the air tank 170 and the regulator 172 to control the opening or closing of the regulator 172. In one example, the valve 206 may include one or more adjustable setpoints, such as an adjustable lower setpoint and an adjustable upper setpoint based on an air pressure within the tank 170. Correspondingly, the valve 206 may open or close one or more ports in response to predetermined air pressure values within the tank 170. In one example, the air pressure within the tank 170 is monitored via the reference line 174, which may constantly apply air pressure from the tank 170 to a reference port 208 of the valve 206. The reference port 208 is configured to adjust the valve 206 (e.g., open or close on or more ports) based on the reference pressure. For example, if the air pressure within the tank 170 reaches a predetermined upper limit a port 214 (e.g., C port) of the valve 206 closes and a port 210 (e.g., a B port) of the valve 206 opens. In one example, the B port 210 may be connected to the reference line 174 such that compressed air from the tank 170 can flow through the B port 210 out of the A port 212. Thus, compressed air may flow into the regulator 172 and close the regulator (against biasing force of biasing element 176), which reduces the process fluid flow to the expander 132 and therefore reduces the compressed air pressure at an outlet of the compressor 158 by reducing the power to the compressor 158.

In another example, if the air pressure reaches a predetermined lower limit, the C port 214 of the valve 206 opens and the B port 210 of the valve 206 closes. Thus, compressed air within the regulator 172 (e.g., from tank 170 via A port 212) that had applied pressure force to close the regulator 172 can flow out of the regulator 172 and into the A port 212. As the B port 210 is now closed, compressed air from the regulator 172 flows out of the C port 214, which is open to the atmosphere. Thus, the biasing element 176 can move the regulator 172 towards the fully-open position. In other words, when the pressure in the tank 170 is low enough, the valve 206 can vent compressed air from regulator 172 to allow the regulator 172 to open. As a result, process fluid flow to the expander 132 is increased, which increases the compressed air pressure at an outlet of the compressor 158 by increasing the power to the compressor 158.

In some implementations, devices or systems disclosed herein can be utilized, manufactured, or installed using methods embodying aspects of the invention. Correspondingly, any description herein of particular features, capabilities, or intended purposes of a device or system is generally intended to include disclosure of a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as embodiments of the invention, of the utilized features and implemented capabilities of such device or system.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C" indicate options of: A and B; B and C; A and C; and A, B, and C.

As used herein, unless otherwise defined or limited, directional terms are used for convenience of reference for discussion of particular figures or examples. For example, references to downward (or other) directions or top (or other) positions may be used to discuss aspects of a particular example or figure, but do not necessarily require similar orientation or geometry in all installations or configurations.

Also as used herein, unless otherwise limited or defined, "substantially parallel" indicates a direction that is within ±12 degrees of a reference direction (e.g., within ±6 degrees), inclusive. For a path that is not linear, the path can be considered to be substantially parallel to a reference direction if a straight line between end-points of the path is substantially parallel to the reference direction or a mean derivative of the path within a common reference frame as the reference direction is substantially parallel to the reference direction.

Also as used herein, unless otherwise limited or defined, "substantially perpendicular" indicates a direction that is within ±12 degrees of perpendicular a reference direction (e.g., within ±6 degrees), inclusive. For a path that is not linear, the path can be considered to be substantially perpendicular to a reference direction if a straight line between end-points of the path is substantially perpendicular to the reference direction or a mean derivative of the path within a common reference frame as the reference direction is substantially perpendicular to the reference direction.

Also as used herein, unless otherwise limited or defined, "integral" and derivatives thereof (e.g., "integrally") describe elements that are manufactured as a single piece without fasteners, adhesive, or the like to secure separate components together. For example, an element stamped, cast, or otherwise molded as a single-piece component from a single piece of sheet metal or using a single mold, without rivets, screws, or adhesive to hold separately formed pieces together is an integral (and integrally formed) element. In contrast, an element formed from multiple pieces that are separately formed initially then later connected together, is not an integral (or integrally formed) element.

Additionally, unless otherwise specified or limited, the terms "about" and "approximately," as used herein with respect to a reference value, refer to variations from the reference value of ±15% or less, inclusive of the endpoints of the range. Similarly, the term "substantially equal" (and the like) as used herein with respect to a reference value refers to variations from the reference value of less than ±30%, inclusive. Where specified, "substantially" can indicate in particular a variation in one numerical direction relative to a reference value. For example, "substantially less" than a reference value (and the like) indicates a value that is reduced from the reference value by 30% or more, and "substantially more" than a reference value (and the like) indicates a value that is increased from the reference value by 30% or more.

Also as used herein, unless otherwise limited or specified, "substantially identical" refers to two or more components or systems that are manufactured or used according to the same process and specification, with variation between the components or systems that are within the limitations of acceptable tolerances for the relevant process and specification. For example, two components can be considered to be substantially identical if the components are manufactured according to the same standardized manufacturing steps, with the same materials, and within the same acceptable dimensional tolerances (e.g., as specified for a particular process or product).

The previous description of the disclosed embodiments is provided to enable any person skilled in the art to make or use the invention. Given the benefit of this disclosure, various modifications to these embodiments will be readily apparent to those skilled in the art, and the principles defined herein may be applied to other embodiments without departing from the spirit or scope of the invention. Thus, the invention is not intended to be limited to the embodiments shown herein but is to be accorded the widest scope consistent with the principles and novel features disclosed herein.

The invention claimed is:

1. An air compressor system, comprising:

a pipeline section including a valve defining an upstream portion and a downstream portion of the pipeline;

an expander configured to selectively receive process fluid from the upstream portion of the pipeline via an input line; and a compressor configured to receive air via an air input line, and to output compressed air to an air tank via an air output line;

wherein the expander powers the compressor via the expansion of the process fluid through the expander and outputs the process fluid into the downstream portion of the pipeline via an output line.

2. The air compressor system of claim 1, wherein the process fluid is natural gas.

3. The air compressor system of claim 1, further comprising:

a differential pressure regulator configured to control flow of process fluid into the expander, to control a rotational speed of the expander.

4. The air compressor system of claim 3, wherein the differential pressure regulator controls the rotational speed of the expander by comparing a pressure in the input line to a pressure in the output line.

5. The air compressor system of claim 4, wherein an air pressure at the air output line correlates to the rotational speed of the expander, such that the differential pressure regulator controls the air pressure at the air output line by comparing the pressure in the input line to the pressure in the output line.

6. The air compressor system of claim 1, further comprising:

an over-pressure regulator configured to control flow of process fluid into the expander based on a pressure in the downstream portion of the pipeline, to prevent flow through the expander when the valve is closed.

7. The air compressor system of claim 1, wherein the air tank supplies compressed air to one or more remotely located instruments.

8. The air compressor system of claim 1, further comprising:

an air pressure regulator in fluid communication with the air tank;

wherein the air pressure regulator is configured to control process fluid flow to the expander through the input line, based on a pressure in the air tank.

9. The air compressor system of claim 1, further comprising:

a fail-open valve arranged to control flow through the input line; and a three-way valve in fluid communication with the air tank and the fail-open valve;

wherein the three-way valve operates to close the fail-open valve when a pressure in the air tank reaches a predetermined upper air-tank limit; and wherein the three-way valve operates to allow the fail-open valve to open when a pressure in the air tank reaches a predetermined lower air-tank limit.

10. The air compressor system of claim 9, further comprising:

a slam-shut valve assembly configured to block flow through the input line in response to a pressure in the downstream portion of the pipeline exceeding a predetermined upper pipeline limit.

11. The air compressor system of claim 1, wherein the input line includes one or more of:

an input port that includes a first pitot tube that opens in an upstream direction of the pipeline; or an output port includes a second pitot tube that opens in a downstream direction of the pipeline.

12. A method of compressing air, the method comprising:

selectively routing process fluid from an upstream portion of a pipeline to an expander, via an input line, the pipeline including a valve between the upstream portion and a downstream portion;

expanding the process fluid with the expander so that the expander rotates to power a compressor, the compressor thereby operating to receive air via an air input line and to output compressed air to an air tank via an air output line; and routing the expanded process fluid from the expander into the downstream portion of the pipeline via an output line.

13. The method of claim 12, further comprising:

controlling a speed of the expander based on a pressure at the output line.

14. The method of claim 13, wherein controlling the speed of the compressor includes controlling a flow rate of the process fluid into the expander with a differential pressure regulator arranged to operate based on a pressure differential across the expander.

15. The method of claim 13, further comprising:

further controlling the speed of the expander by controlling flow along the input line with an air pressure regulator that is in fluid communication with the air tank.

16. The method of claim 15, wherein the air pressure regulator is upstream of a differential pressure regulator that is configured to control the speed of the compressor by controlling a flow rate of the process fluid into operate based on a pressure differential across the expander.

17. The method of claim 13, further comprising:

further controlling the speed of the expander by controlling flow along the input line with a three-way switching valve that is in communication with the air tank.

18. An air compressor system, comprising:

a process fluid portion, including:

a pipeline section that includes a valve defining an upstream portion and a downstream portion of the pipeline; and an expander in fluid communication with the pipeline, the expander configured to selectively receive process fluid from the upstream portion of the pipeline via an input line and provide expanded process fluid to the downstream portion of the pipeline via an output line; and an instrument air portion, including:

a compressor in mechanical communication with the expander to be powered by rotation of the expander, the compressor being configured to receive air for compression at an inlet; and an air tank in fluid communication with an outlet of the compressor, the air tank configured to supply compressed air from the compressor to one or more pneumatic instruments;

wherein flow of process fluid from the upstream portion of the pipeline to the downstream portion of the pipeline, via the expander, powers the compressor to supply the compressed air to the air tank.

19. The air compressor system of claim 18, wherein a speed of the compressor is controlled by a plurality of regulators in series along the input line.

20. The air compressor system of claim 18, further comprising one or more of:

a pressure-increasing inlet port configured to provide process fluid to the input line from the upstream portion of the pipeline; or a pressure-reducing outlet port configured to provide expanded process fluid from the output line to the downstream portion of the pipeline.

* * * * *